US009564021B2

(12) United States Patent
Stewart et al.

(10) Patent No.: US 9,564,021 B2
(45) Date of Patent: Feb. 7, 2017

(54) GAMING SYSTEM AND A METHOD OF GAMING

(71) Applicant: Aristocrat Technologies Australia Pty Limited, North Ryde (AU)

(72) Inventors: Scott Monroe Stewart, Las Vegas, NV (US); Tricia Tylman, Las Vegas, NV (US)

(73) Assignee: Aristocrat Technologies Australia Pty Limited, North Ryde, NSW (AU)

( * ) Notice: Subject to any disclaimer, the term of this patent is extended or adjusted under 35 U.S.C. 154(b) by 0 days.

(21) Appl. No.: 13/909,599

(22) Filed: Jun. 4, 2013

(65) Prior Publication Data

US 2014/0018148 A1 Jan. 16, 2014

Related U.S. Application Data

(60) Provisional application No. 61/656,387, filed on Jun. 6, 2012.

(51) Int. Cl.

| | |
|---|---|
| ***A63F 9/24*** | (2006.01) |
| ***G07F 17/34*** | (2006.01) |
| ***G07F 17/32*** | (2006.01) |

(52) U.S. Cl.

CPC ..... *G07F 17/34* (2013.01); *G07F 17/3211* (2013.01)

(58) Field of Classification Search

CPC .. G07F 17/3211; G07F 17/34; G07F 17/3209; G07F 17/3267; G07F 17/326; G07F 17/3213; G07F 17/3202; G07F 17/3204; G07F 17/3286; A63F 13/06; A63F 2001/008; G06F 3/03547; G02F 1/13338

USPC ..... 463/16–20, 30

See application file for complete search history.

(56) References Cited

U.S. PATENT DOCUMENTS

| | | | | |
|---|---|---|---|---|
| 6,083,105 | A | 7/2000 | Ronin | |
| 7,410,420 | B2 | 8/2008 | Shiraishi | |
| 2004/0198485 | A1* | 10/2004 | Loose et al. | 463/20 |
| 2004/0209673 | A1 | 10/2004 | Shiraishi | |
| 2007/0015565 | A1* | 1/2007 | Chan | 463/20 |
| 2008/0096655 | A1* | 4/2008 | Rasmussen et al. | 463/31 |
| 2008/0188283 | A1 | 8/2008 | Okada | |
| 2009/0117977 | A1* | 5/2009 | Gelber | G07F 17/3211 463/20 |

(Continued)

FOREIGN PATENT DOCUMENTS

| | | | |
|---|---|---|---|
| DE | 19728203 | A1 | 1/1999 |
| DE | 19728203 | B4 | 4/2004 |

(Continued)

*Primary Examiner* — Steve Rowland

(74) *Attorney, Agent, or Firm* — Armstrong Teasdale LLP

(57) ABSTRACT

A gaming system is disclosed that comprises a selector arranged to select a plurality of first symbols from a first set of symbols for display in a display position area, and a shutter device selectively disposable in a closed configuration wherein the display position area is concealed or an open configuration wherein the display position area is revealed. The gaming system is arranged to select a plurality of second symbols from a second set of symbols. The shutter device comprises a display device arranged to display the selected second symbols at a location corresponding to the display position area when the shutter device is disposed in the closed configuration. A corresponding method is also disclosed.

32 Claims, 9 Drawing Sheets

(56) References Cited

U.S. PATENT DOCUMENTS

| | | | | |
|---|---|---|---|---|
| 2009/0275386 | A1* | 11/2009 | Vallejo et al. | 463/20 |
| 2010/0124982 | A1* | 5/2010 | Stewart G07F 17/3211 | 463/20 |
| 2011/0117990 | A1* | 5/2011 | Wilkins et al. | 463/20 |
| 2012/0077564 | A1* | 3/2012 | Collette et al. | 463/20 |

FOREIGN PATENT DOCUMENTS

| | | | | |
|---|---|---|---|---|
| GB | 189701965 | A | | 0/1897 |
| GB | 191311340 | A | | 0/1914 |
| GB | 195031 | A | | 3/1923 |
| GB | 364632 | A | | 1/1932 |
| GB | 394203 | A | | 6/1933 |
| GB | 413981 | A | | 7/1934 |
| GB | 414861 | A | | 8/1934 |
| GB | 503242 | A | | 4/1939 |
| GB | 2187394 | A | | 9/1987 |
| GB | 2470597 | A | | 12/2010 |
| JP | 62024233 | A | | 2/1987 |
| JP | 446477 | A | | 2/1992 |
| JP | 479971 | A | | 3/1992 |
| JP | 5245260 | A | | 9/1993 |
| JP | 7284012 | A | | 10/1995 |
| JP | 7289706 | A | | 11/1995 |
| JP | 8173591 | A | | 7/1996 |
| JP | 2623154 | B2 | | 6/1997 |
| JP | 10000267 | A | | 1/1998 |
| JP | 10155974 | A | | 6/1998 |
| JP | 2000024273 | A | | 1/2000 |
| JP | 3118943 | B2 | | 12/2000 |
| JP | 3487361 | B2 | | 1/2004 |
| JP | 2004179852 | A | | 6/2004 |
| JP | 2005074070 | A | | 3/2005 |
| JP | 2005086731 | A | | 3/2005 |
| JP | 2005224286 | A | | 8/2005 |
| JP | 2005244459 | A | | 9/2005 |
| JP | 2005287932 | A | | 10/2005 |
| JP | 2006-034554 | A | † | 2/2006 |
| JP | 2006034554 | A | | 2/2006 |
| JP | 2006034555 | A | | 2/2006 |
| JP | 2006198200 | A | | 8/2006 |
| JP | 3829159 | B2 | | 10/2006 |
| JP | 2006325803 | A | | 12/2006 |
| JP | 2007000396 | A | | 1/2007 |
| JP | 2009005934 | A | | 1/2009 |
| JP | 4223009 | B2 | | 2/2009 |
| JP | 2009072436 | A | | 4/2009 |
| JP | 2009285262 | A | | 12/2009 |
| JP | 4466170 | B2 | | 5/2010 |
| JP | 2010131440 | A | | 6/2010 |
| JP | 2010162246 | A | | 7/2010 |
| MX | 9605215 | A | | 9/1997 |
| MX | PA03011265 | A | | 10/2004 |
| WO | 2011029589 | A | | 3/2011 |

* cited by examiner
† cited by third party

GAMING SYSTEM AND A METHOD OF GAMING

RELATED APPLICATIONS

This application claims priority to U.S. Provisional Patent Application No. 61/656,387 having a filing date of Jun. 6, 2012 which is incorporated herein by reference in its entirety.

FEDERALLY SPONSORED RESEARCH OR DEVELOPMENT

[Not Applicable]

MICROFICHE/COPYRIGHT REFERENCE

[Not Applicable]

BACKGROUND OF THE INVENTION

It is known to provide a gaming system arranged to randomly display several symbols from a predetermined set of symbols and to determine a game outcome such as a game win based on the displayed symbols.

Such gaming systems may commonly be implemented as a stepper machine provided with reels with each reel carrying several symbols of the set, or a video machine wherein selected symbols are displayed on virtual reels on a graphical display device.

However, while such gaming systems provide users with enjoyment, a need exists for alternative gaming systems in order to maintain or increase player enjoyment.

BRIEF SUMMARY OF THE INVENTION

In accordance with a first aspect of the present invention, there is provided a gaming system comprising:

a selector arranged to select a plurality of first symbols from a first set of symbols for display in a display position area; and a shutter device selectively disposable in a closed configuration wherein the display position area is concealed or an open configuration wherein the display position area is revealed;

the gaming system being arranged to select a plurality of second symbols from a second set of symbols;

the shutter device comprising a display device arranged to display the selected second symbols at a location corresponding to the display position area when the shutter device is disposed in the closed configuration.

In one embodiment, the gaming system comprises a plurality of reels, which may be physical or virtual reels.

In one embodiment, the first set of symbols are associated with the reels, and the selector is arranged to select symbols from the first set of symbols by controlling the stopping positions of the reels.

In one embodiment, the second set of symbols comprise representations of playing cards, and the gaming system may be arranged to determine whether the selected second set of symbols corresponds to a winning outcome according to rules for poker.

In one embodiment, the gaming system comprises a cover member disposed in front of the display position area, wherein the display position area is visible through the cover member when the shutter device is disposed in the open configuration and the display position area is not visible through the cover member when the shutter device is disposed in the closed configuration.

In one embodiment, the cover member comprises at least one aperture and the shutter device is arranged to cover the at least one aperture when the shutter device is disposed in the closed configuration. The shutter device may be reciprocably movable between the open configuration and the closed configuration.

In an embodiment wherein the gaming system comprises a plurality of reels, the gaming system may comprise one shutter member arranged to conceal the reels when the shutter device is disposed in the closed configuration, or may comprise a shutter member for each reel, each shutter member being arranged to conceal one reel when the shutter device is disposed in the closed configuration.

In one embodiment, the cover member comprises the shutter device, the display device of the shutter device being operable in a substantially transparent state wherein the selected first symbols are visible through the display device and in a substantially non-transparent state wherein the selected second symbols are visible on the display device and the selected first symbols are not visible through the display device.

In one embodiment, the gaming system comprises a touch screen usable by a player to control operation of a game associated with the first and/or second set of symbols. The touch screen may be substantially light transmissive, and may be disposed over the display position area.

The gaming system may be operable in base game mode or special game mode, wherein:

in base game mode, the shutter device is disposed in the open configuration and second symbols are not selected; and in special game mode, the shutter device is disposed in the closed configuration and second symbols are selected and displayed on the shutter device.

In one embodiment, the gaming system is arranged to commence special game mode when a trigger condition occurs.

In one embodiment, the gaming system is arranged to commence special game mode in response to player input, based on the amount or type of bet placed, or when a special game is purchased by a player.

The trigger condition may be display of a particular symbol, or display of a defined symbol combination.

In accordance with a second aspect of the present invention, there is provided a method of gaming comprising:

selecting a plurality of first symbols from a first set of symbols;

displaying the selected first symbols in a display position area;

providing a shutter device;

selectively disposing the shutter device in a closed configuration wherein the display position area is concealed or an open configuration wherein the display position area is revealed;

selecting a plurality of second symbols from a second set of symbols; and displaying a plurality of second symbols on the shutter device at a location corresponding to the display position area when the shutter is disposed in the closed configuration.

In accordance with a third aspect of the present invention there is provided a computer program arranged when loaded into a computer to instruct the computer to operate in accordance with the gaming system of the first aspect.

In accordance with a fourth aspect of the present invention, there is provided a computer readable medium having a computer readable program code embodied therein for causing a computer to operate in accordance with the gaming system of the first aspect.

In accordance with a fifth aspect of the present invention, there is provided a data signal having a computer readable program code embodied therein to cause a computer to operate in accordance with the gaming system of the first aspect.

BRIEF DESCRIPTION OF SEVERAL VIEWS OF THE DRAWINGS

The present invention will now be described, by way of example only, with reference to the accompanying drawings, in which.

DETAILED DESCRIPTION OF THE INVENTION

Figure 1:
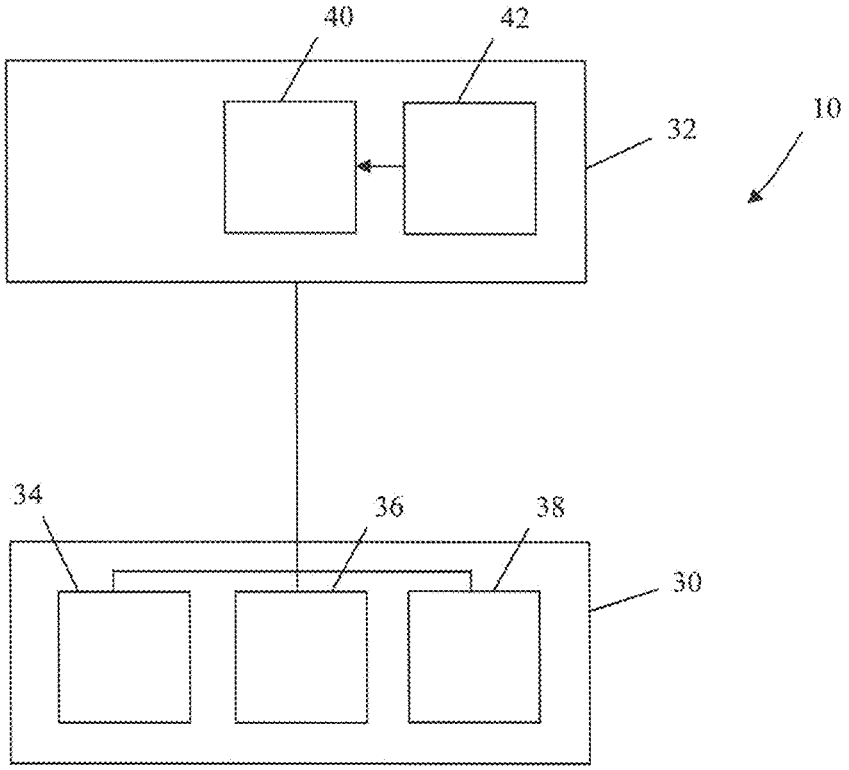
FIG. 1 is a schematic block diagram of components of a gaming system in accordance with an embodiment of the present invention.

The present gaming system operates such that during normal game play a first game is implemented and during special game mode a second game is implemented. The first game involves selecting and displaying first symbols at a display location, and the second game involves selecting and displaying second symbols at the same display location. A shutter disposable in an open or closed configuration is provided to enable the first and second symbols to be selectively displayed at the same display location.

In one arrangement, the first symbols are randomly selected from a first set of symbols and displayed in corresponding display position groups, each of which comprises a plurality of display positions. The symbols shown at the display positions are used to determine game outcomes by comparing the displayed symbols with defined winning combinations. In at least some embodiments, the display position groups are each associated with a reel of a spinning reel type game.

Likewise, the second symbols are randomly selected from a second set of symbols and displayed in corresponding display position groups. The symbols shown at the display positions are used to determine game outcomes by comparing the displayed symbols with defined winning combinations. In at least some embodiments, the display positions are associated with playing card selections of a video poker type game.

In one conventional type of gaming machine, a spinning reel type game comprises a display area including 15 display positions, with each display position including one symbol. The display positions are arranged in five vertically disposed reels, with each reel corresponding with a display position group, and each reel having three visible display positions. After the reels are spun and subsequently stopped, the display positions show a random selection of symbols.

Generally, with such games, a plurality of win patterns in the form of win lines are defined which extend across the reels and include one display position from each reel. Typically the symbols that are disposed in a win line are compared with winning symbol combinations defined in a pay table so as to determine whether a player of the game should receive an award. For example, if winning symbol combinations are based on poker hands, a particular prize would be awarded if the win line comprises four aces. Other winning symbol combinations and corresponding prizes may also be defined.

In another conventional type of gaming machine, a poker type game comprises a display area including 5 display positions, with each display position including one symbol in the form of a representation of a playing card. Symbols are randomly selected and displayed in the 5 display positions, and the player is provided with an opportunity to replace one or more, but usually not all, of the displayed symbols. After selection and subsequent replacement of the selected symbols, or after the player elects to keep the originally displayed symbols, the displayed symbols are evaluated according to poker rules to determine whether a win condition exists.

With the present system, a first type of game, such as a spinning reel type game, is implemented during normal game mode, and a second type of game, such as a video poker type game, is implemented during special game mode.

Referring to the drawings, there is shown a schematic block diagram of a gaming system 10 arranged to implement a probabilistic game of the type wherein several symbols from a set of symbols are randomly displayed, and a game outcome is determined on the basis of the displayed symbols. The system is of the type including multiple game modes, such as normal game mode wherein a base game is implemented and special game mode wherein a feature game is implemented.

With the present embodiment, a mechanical spinning reel type game is implemented during normal game mode. The set of symbols used include standard symbols and function symbols, and the game outcome is determined on the basis of the displayed standard symbols and the function associated with any displayed function symbol. For example, standard symbols may resemble fruit such as apples, pears and bananas with a win outcome being determined when a predetermined number of the same fruit appear on a display along a win line, or are displayed according to defined outcome patterns such as scattered, and so on. The function associated with a function symbol may be for example a wild function wherein display of the function symbol is treated during consideration of the game outcome as any of the standard symbols. A function symbol may be represented as the word "WILD", a star, or by any other suitable word or symbol. Other functions are also envisaged such as scatter functions, multiplier functions, repeat win functions, jackpot functions and feature commencement functions.

Also with the present embodiment, a video poker type game is implemented during special game mode. The set of symbols used include representations of playing cards, and the game outcome is determined on the basis of the displayed playing card representations according to poker game rules.

Referring to FIG. 1, a schematic diagram of components of a gaming system 10 in accordance with the present embodiment is shown. The components comprise a player interface 30 and a game controller 32. The player interface 30 is arranged to enable interaction between a player and the gaming system and for this purpose includes input/output components required for the player to enter instructions and play the game.

Components of the player interface 30 may vary but will typically include a credit mechanism 34 to enable a player to input credits and receive payouts, one or more displays 36 which may comprise a touch screen, and a game play mechanism 38 arranged to enable a player to input game play instructions.

The game controller 32 is in data communication with the player interface 30 and typically includes a processor 40 arranged to process game play instructions and output game player outcomes to the display 36. Typically, the game play instructions are stored as program code in a memory 42 that can also be hardwired. It will be understood that in this specification the term "processor" is used to refer generically to any device that can process game play instructions and may include a microprocessor, microcontroller, programmable logic device or other computational device such as a personal computer or a server.

Figure 2:
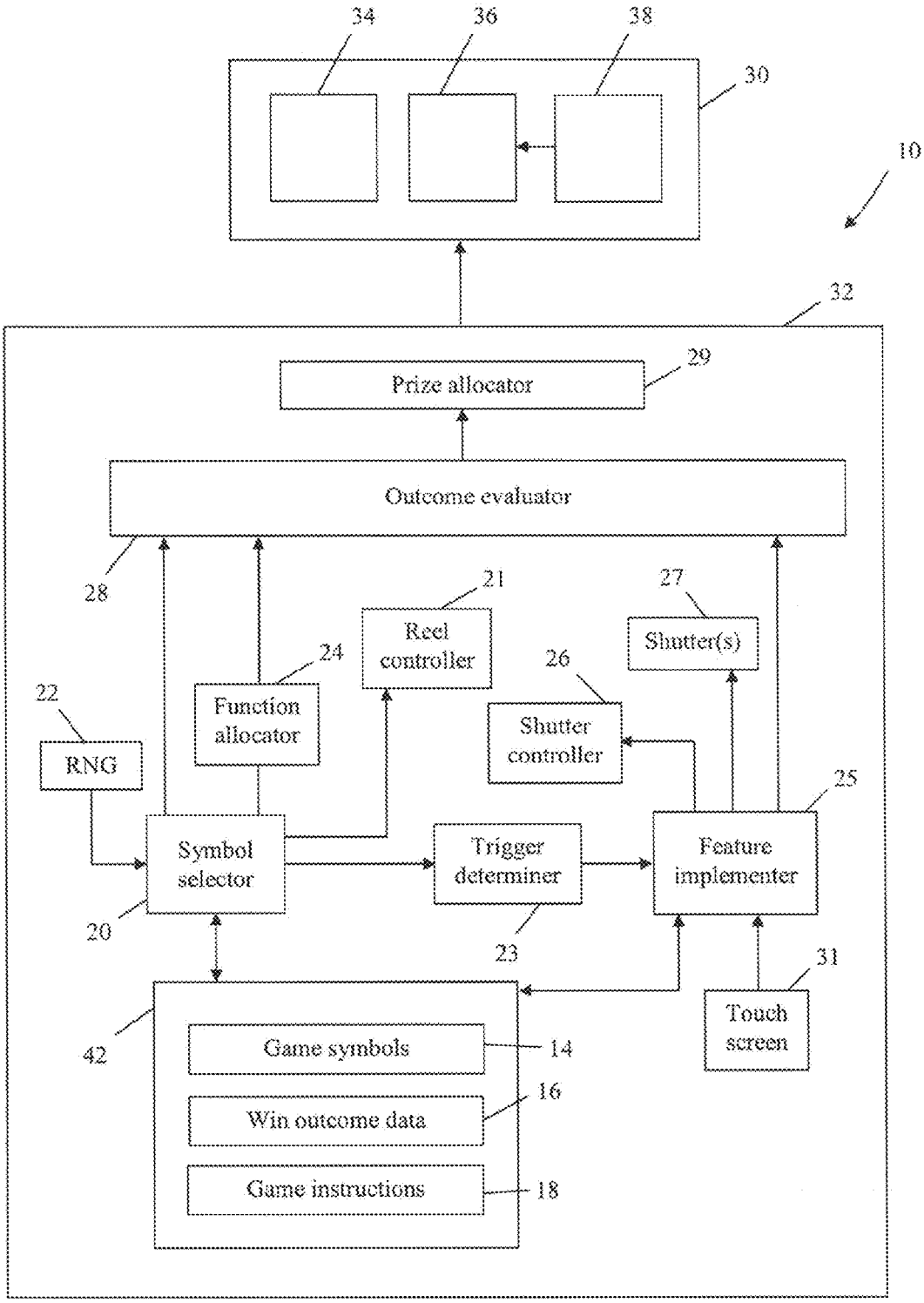
FIG. 2 is a schematic block diagram of functional components of a gaming system in accordance with an embodiment of the present invention.

A functional diagram illustrating operative components of the game controller 32 is shown in FIG. 2.

The memory 42 is arranged to store symbols data 14 indicative of representations of playing cards for use with the video poker game, win outcome data 16 indicative of win condition requirements for the spinning reel and poker games, and game instruction data 18 indicative of game instructions usable by the gaming machine 10 to control operation of the games.

The game controller 32 includes a symbol selector 20 which is arranged during normal game mode to select several symbols for display to a player in a plurality of display positions on a plurality of reels, and a reel controller 21 arranged to control spinning and stopping of the reels so that the reels stop with the selected symbols displayed. In this example, the selection carried out by the symbol selector 20 is made using a random number generator 22.

It will be appreciated that the random number generator 22 may be of a type which is arranged to generate pseudo random numbers based on a seed number, and that in this specification the term "random" will be understood accordingly to mean truly random or pseudo random.

With this embodiment, the game controller 32 also comprises a trigger determiner 23 arranged to determine whether a trigger condition exists, and a feature implementer 25 arranged to implement a feature game when a trigger condition is determined to exist.

During a feature game, the feature implementer 25 instructs a shutter controller 26 to close one or more shutters 27 so that the reels used during normal game mode are concealed. The shutter(s) 27 include one or more video display devices arranged to display representations of playing cards. Playing cards are then selected from the game symbols 14 and the shutter(s) 27 controlled to display the selected playing cards. The shutter(s) cover the reels such that selected playing cards are displayed at locations corresponding to the locations of the visible portions of the reels used during normal game mode.

In the present example, the player is provided with the option of replacing some, but not all, of the displayed playing cards, and in this example up to 3 cards may be replaced. Selection of the playing cards to be replaced is facilitated using any suitable input device, such as using a touch screen 31 arranged to overlie the display area of the gaming system. After selection by a player of cards to be replaced, further playing cards are selected and displayed on the shutter(s) 27.

The game controller 32 also comprises an outcome evaluator 28 which, in accordance with game instructions 18, determines game outcomes based on the symbols selected for display to the player by the symbol selector 20 during normal game mode after all reels have stopped spinning, and based on playing cards selected for display to a player during special game mode.

The game controller 32 also comprises a prize allocator 29 arranged to allocate a prize to a player when a winning outcome exists.

In the present embodiment, the symbol selector 20, the trigger determiner 23, the function allocator 24, the feature implementer 25, the reel controller 21, the shutter controller 26, the outcome evaluator 28, and the prize allocator 29 are at least partly implemented using the processor 40 and associated software although it will be understood that other implementations are envisaged.

The gaming system 10 can take a number of different forms.

In a first form, a player operable gaming device in the form of a stand alone gaming machine is provided wherein all or most components required for implementing the game are present in the gaming machine.

In a second form, a distributed architecture is provided wherein some of the components required for implementing the game are present in a player operable gaming device and some of the components required for implementing the game are located remotely relative to the gaming device. For example, a "thick client" architecture may be used wherein part of the game is executed on a player operable gaming terminal and part of the game is executed remotely, such as by a gaming server; or a "thin client" architecture may be used wherein most of the game is executed remotely such as by a gaming server and a player operable gaming terminal is used only to display audible and/or visible gaming information to the player and receive gaming inputs from the player.

However, it will be understood that other arrangements are envisaged. For example, an architecture may be provided wherein a gaming device is networked to a device server and the respective functions of the gaming machine and the gaming server are selectively modifiable. For example, the gaming system may operate in stand alone gaming machine mode, "thick client" mode or "thin client" mode depending on the game being played, operating conditions, and so on. Other variations will be apparent to persons skilled in the art.

Figure 3:
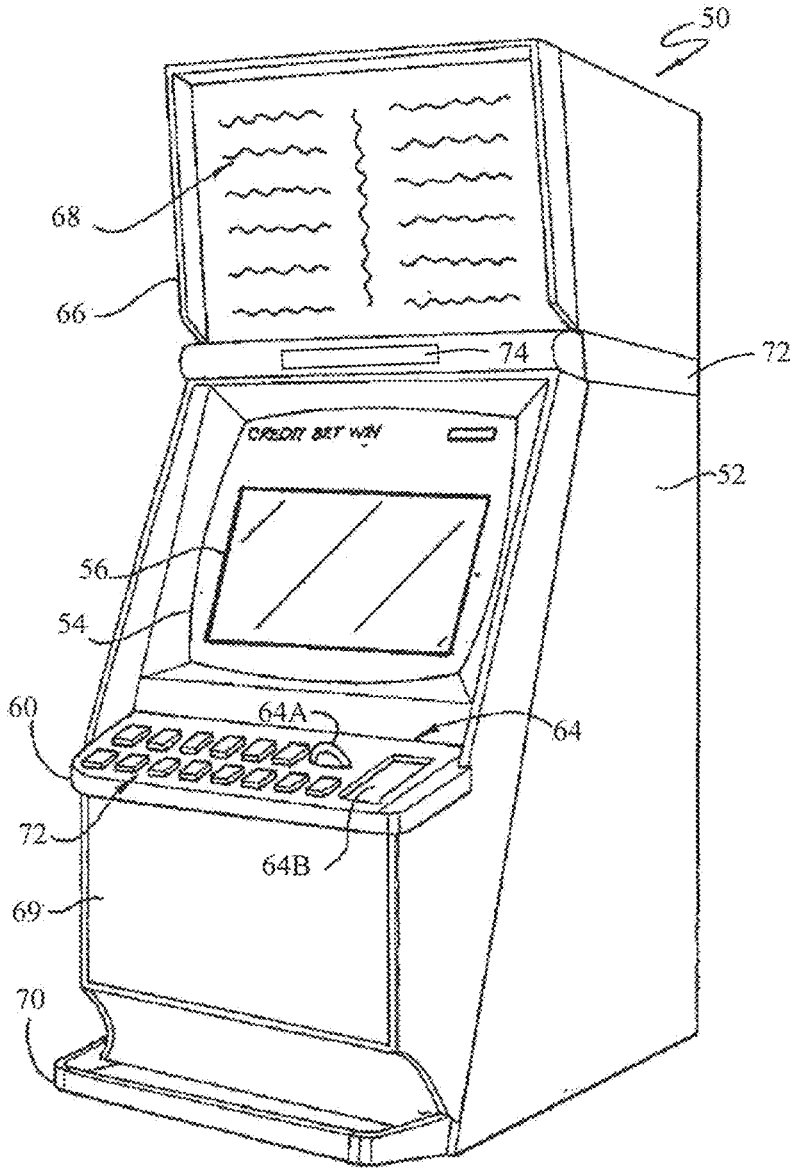
FIG. 3 is a diagrammatic representation of a gaming system in accordance with an embodiment of the present invention with the gaming system implemented in the form of a stand alone gaming machine.

A gaming system in the form of a stand alone gaming machine 50 is illustrated in FIG. 3. The gaming machine 50 includes a console 52 having a display device 54 on which is displayed representations of a game 56 that can be played by a player. A mid-trim 60 of the gaming machine 50 houses a bank of buttons 62 for enabling a player to interact with the gaming machine, in particular during gameplay. The mid-trim 60 also houses a credit input mechanism 64 which in this example includes a coin input chute 64A and a bill collector 64B. Other credit input mechanisms may also be employed, for example, a card reader for reading a smart card, debit card or credit card.

A top box 66 may carry artwork 68, including for example pay tables and details of bonus awards and other information or images relating to the game. Further artwork and/or information may be provided on a front panel 69 of the console 52. A coin tray 70 is mounted beneath the front panel 69 for dispensing cash payouts from the gaming machine 50.

The top box 66 may also include a display, for example a video display unit which may incorporate a liquid crystal display, plasma screen, or any other suitable video display unit.

Figure 4:
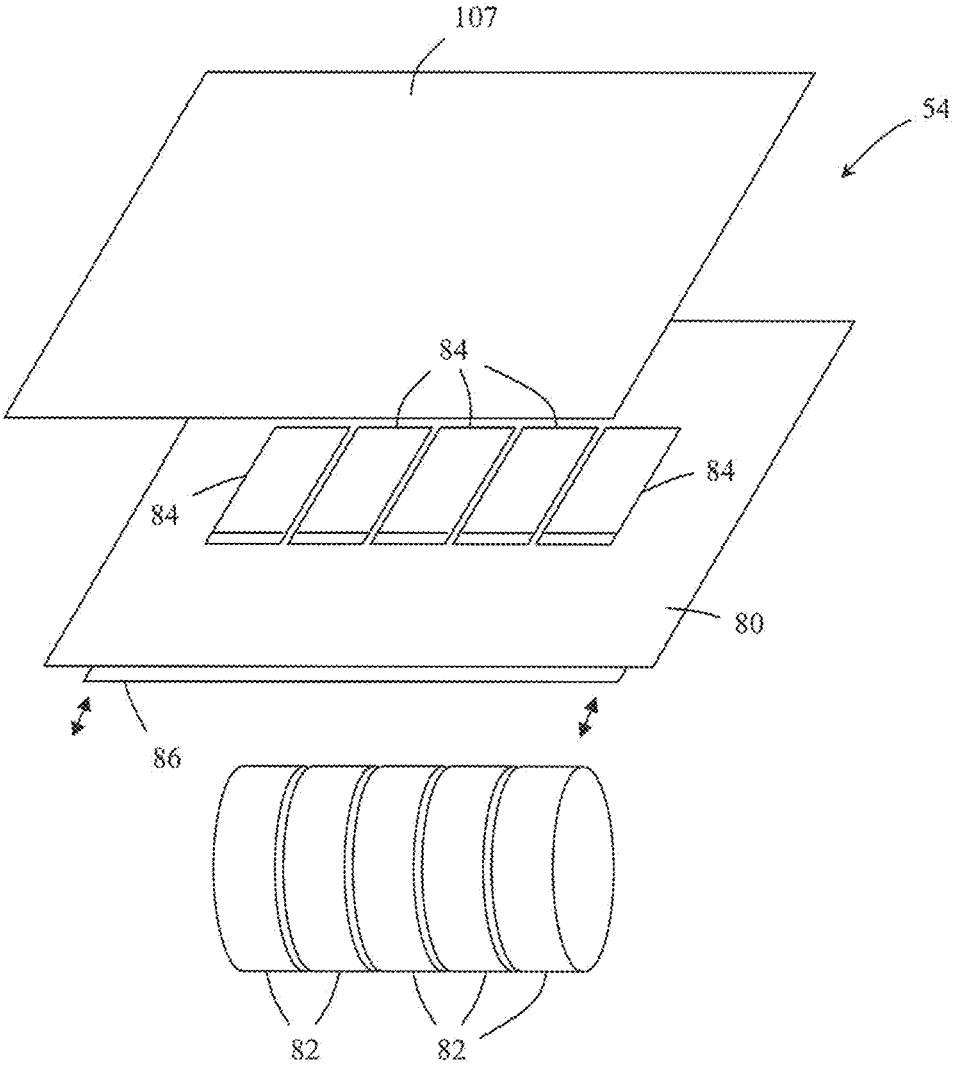
FIG. 4 is a diagrammatic representation of a display device of the gaming machine shown in FIG. 3.

As shown more particularly in FIG. 4, the display device 54 comprises a cover member 80, in this example a video display unit 80.

The display device 54 also comprises a plurality of mechanical reels 82 disposed during use behind apertures 84 provided in the video display unit 80 and aligned with the apertures 84 such that at least some symbols (not shown) on each reel 82 are visible through the apertures 84.

A shutter 86 is disposed between the apertures 84 and the reels 82, and the shutter 86 is movable between an open position wherein the reels 82 are visible through the apertures 84, and a closed position wherein the reels 82 are not visible through the apertures 84. The shutter 86 in this example is a video display unit, which may incorporate a liquid crystal display, plasma screen, or any other suitable video display unit. In this example, the shutter 86 is used to display selected symbols during implementation of a feature game during special game mode, with each selected symbol being aligned with a respective aperture 84.

A touch screen 107 is also provided, the touch screen being substantially transparent and overlying the video display unit. During use, the touch screen 107 may be used to receive inputs from a player, for example selections of playing cards to retain during a poker type game implemented during special game mode.

It will be understood that with the shutter 86 disposed in the open position, the reels 82 are visible through the apertures 84 and the gaming machine implements a reel type game wherein reel symbols are viewable through the apertures 84. With the shutter 86 disposed in the closed position, instead of the reels, the playing cards of the feature game are visible through the apertures 84, and the gaming machine implements a poker type game with playing card symbols viewable through the apertures 84.

In this way, for both normal and special game mode, relevant symbols are displayed to a player through the apertures 84.

Typically, during operation of the game, the reels first appear to rotate then stop with typically three symbols visible on each reel. Game outcomes are determined on the basis of the visible symbols together with any special functions associated with the symbols.

A player marketing module (PMM) 72 having a display 74 is connected to the gaming machine 50. The main purpose of the PMM 72 is to allow the player to interact with a player loyalty system. The PMM has a magnetic card reader for the purpose of reading a player tracking device, for example as part of a loyalty program. However other reading devices may be employed and the player tracking device may be in the form of a card, flash drive or any other portable storage medium capable of being read by the reading device. In this example, the PMM 62 is a Sentinel III device produced by Aristocrat Technologies Pty Ltd.

Figure 5:
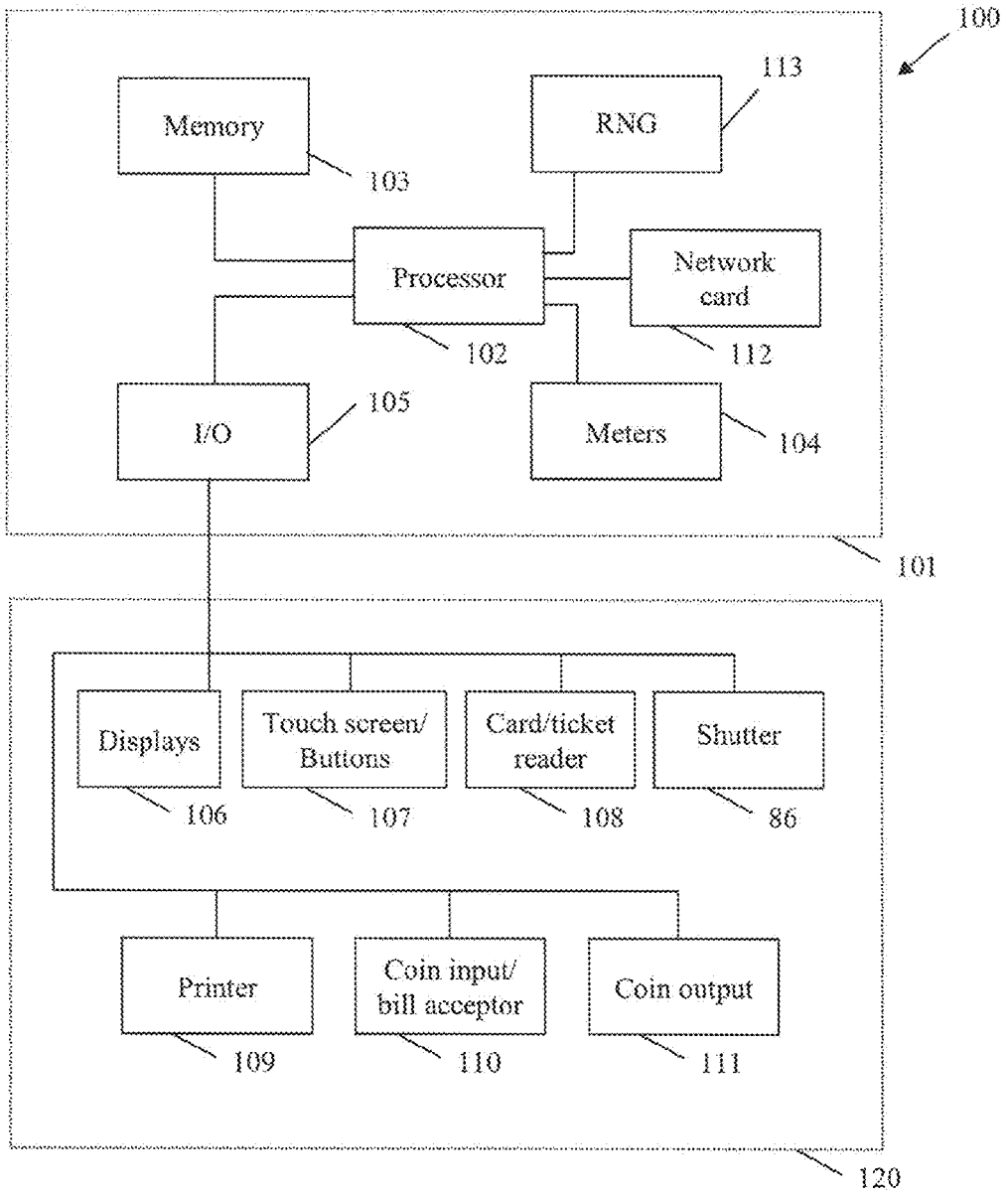
FIG. 5 is a schematic block diagram of operative components of the gaming machine shown in FIG. 3.

FIG. 5 shows a block diagram of operative components of a gaming device 100 which may be the same as or different to the gaming machine shown in FIG. 3.

The gaming machine 100 includes a game controller 101 having a processor 102. Instructions and data to control operation of the processor 102 in accordance with the present invention are stored in a memory 103 which is in data communication with the processor 102.

Typically, the gaming machine 100 will include both volatile and non-volatile memory and more than one of each type of memory, with such memories being collectively represented by the memory 103.

Figure 6:
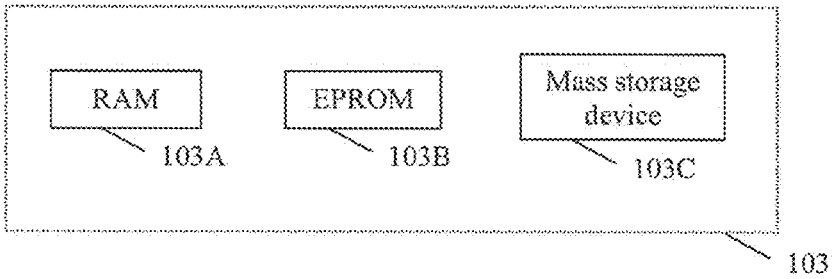
FIG. 6 is a schematic block diagram of components of a memory of the gaming machine shown in FIG. 3.

FIG. 6 shows a block diagram of the main components of an exemplary memory 103. The memory 103 includes RAM 103A, EPROM 103B and a mass storage device 103C. The RAM 103A typically temporarily holds program files for execution by the processor 102 and related data. The EPROM 103B may be a boot ROM device and/or may contain some system or game related code. The mass storage device 103C is typically used to store game programs, the integrity of which may be verified and/or authenticated by the processor 102 using protected code from the EPROM 103B or elsewhere.

The gaming machine has hardware meters 104 for purposes including ensuring regulatory compliance and monitoring player credit, an input/output (I/O) interface 105 for communicating with a player interface 120 of the gaming machine 100, the player interface 120 having several peripheral devices. The input/output interface 105 and/or the peripheral devices may be intelligent devices with their own memory for storing associated instructions and data for use with the input/output interface or the peripheral devices. A random number generator module 113 generates random numbers for use by the processor 102.

In the example shown in FIG. 5, the peripheral devices that communicate with the game controller 101 comprise one or more displays 106; a touch screen and/or bank of buttons 107 including at least one input device, such as at least one button, to enable a player to provide an indication as to whether the player wishes to keep symbols displayed in some of the reels or re-spin the reels; a card and/or ticket reader 108; a printer 109; a bill acceptor and/or coin input mechanism 110; a coin output mechanism 111; and a shutter 86. Additional hardware may be included as part of the gaming machine 100, or hardware may be omitted as required for the specific implementation.

In addition, the gaming machine 100 may include a communications interface, for example a network card 112. The network card may, for example, send status information, accounting information or other information to a central controller, server or database and receive data or commands from the central controller, server or database.

It is also possible for the operative components of the gaming machine 100 to be distributed, for example input/output devices 106,107,108,109,110,111 may be provided remotely from the game controller 101.

Figure 7:
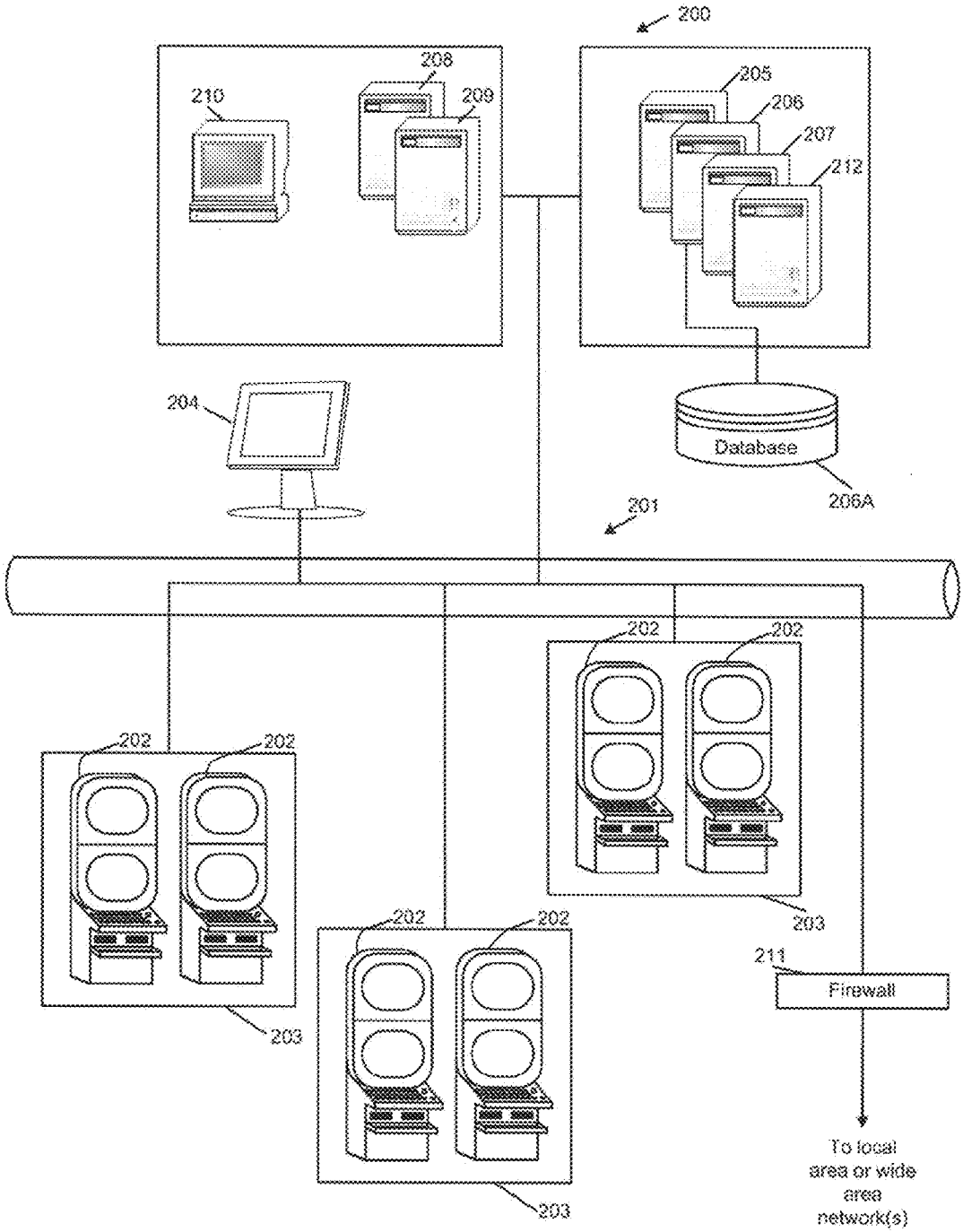
FIG. 7 is a schematic diagram of a gaming system in accordance with an alternative embodiment of the present invention wherein the gaming system is implemented over a network.

FIG. 7 shows a gaming system 200 in accordance with an alternative embodiment. The gaming system 200 includes a network 201, which for example may be an Ethernet network, a LAN or a WAN. In this example, three banks 203 of two gaming machines 202 are connected to the network 201. The gaming machines 202 provide a player operable interface and may be the same as the gaming machines 40,100 shown in FIGS. 3 and 5, or may have simplified functionality depending on the requirements for implementing game play. While banks 203 of two gaming machines are illustrated in FIG. 7, banks of one, three or more gaming machines are also envisaged.

One or more displays 204 may also be connected to the network 201. The displays 204 may, for example, be associated with one or more banks 203 of gaming machines. The displays 204 may be used to display representations associated with game play on the gaming machines 202, and/or used to display other representations, for example promotional or informational material.

In a thick client embodiment, a game server 205 implements part of the game played by a player using a gaming machine 202 and the gaming machine 202 implements part of the game. With this embodiment, as both the game server 205 and the gaming machine 202 implement part of the game, they collectively provide a game controller. A database management server 206 may manage storage of game programs and associated data for downloading or access by the gaming devices 202 in a database 206A. Typically, if the gaming system enables players to participate in a Jackpot game, a Jackpot server 207 will be provided to monitor and carry out the Jackpot game.

In a variation of the above thick client embodiment, the gaming machine 202 may implement the game, with the game server 205 functioning merely to serve data indicative of a game to the gaming machine 202 for implementation.

With this implementation, a data signal containing a computer program usable by the client terminal to implement the gaming system may be transferred from the game server to the client terminal, for example in response to a request by the client terminal.

In a thin client embodiment, the game server 205 implements most or all of the game played by a player using a gaming machine 202 and the gaming machine 202 essentially provides only the player interface. With this embodiment, the game server 205 provides the game controller. The gaming machine will receive player instructions, and pass the instructions to the game server which will process them and return game play outcomes to the gaming machine for display. In a thin client embodiment, the gaming machines could be computer terminals, e.g. PCs running software that provides a player interface operable using standard computer input and output components.

Servers are also typically provided to assist in the administration of the gaming system 200, including for example a gaming floor management server 208 and a licensing server 209 to monitor the use of licenses relating to particular games. An administrator terminal 210 is provided to allow an administrator to monitor the network 201 and the devices connected to the network.

The gaming system 200 may communicate with other gaming systems, other local networks such as a corporate network, and/or a wide area network such as the Internet, for example through a firewall 211.

A loyalty program server 212 may also be provided.

Persons skilled in the art will appreciate that in accordance with known techniques, functionality at the server side of the network may be distributed over a plurality of different computers. For example, elements may be run as a single "engine" on one server or a separate server may be provided. For example, the game server 205 could run a random number generator engine.

Alternatively, a separate random number generator server could be provided.

Examples of specific implementations of the gaming system will now be described in relation to a stand alone gaming machine 50 although it will be understood that implementation may also be carried out using other gaming system architectures such as a network architecture of the type shown in FIG. 7.

The gaming system is operable in normal game mode and special game mode and may be arranged to commence special game mode when a predetermined game outcome occurs. Special game mode may comprise one or more free games.

Special game mode may commence automatically on the basis of a game event occurring during a game such as display of a particular symbol, based on game outcomes determined by the gaming system, or may be prompted by a player pressing a button on the gaming system 10 after the player has identified that a game outcome corresponding to special game mode requirements has occurred.

The gaming system 10 may also be arranged so as to determine eligibility for special game mode, for example based on the amount or type of bet placed, based on particular time periods and so on.

Special game mode may also be arranged to commence when a special game is purchased by a player.

Figure 8:
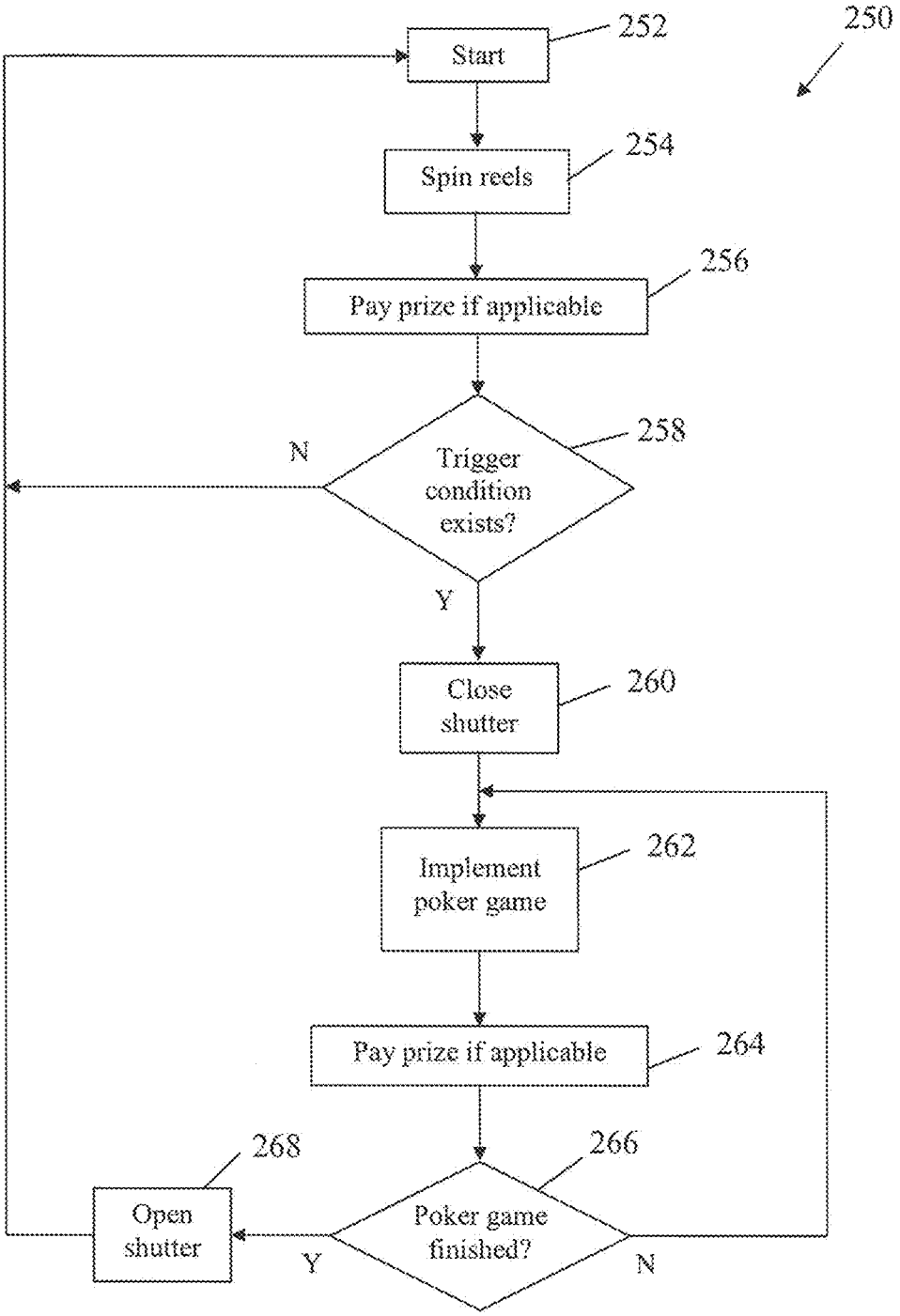
FIG. 8 is a flow diagram illustrating game play of a gaming system in accordance with an embodiment of the present invention.

A specific example will now be described in relation to flow diagram 250 shown in FIG. 8, which illustrates steps 252 to 268 of a method of gaming implemented by the gaming system according to the present embodiment, and representations of the display device 54 shown in FIGS. 10 and 11.

In this example, the gaming system comprises five reels 82 arranged to display standard symbols and one or more function symbols during implementation of a base game. Win outcomes are determined on the basis of the symbols visible at the display positions when the reels stop.

Typically, a player will purchase or otherwise obtain win entitlements such as several win lines which are used in the game to determine win outcomes. If the displayed symbols on the reels have symbols associated with a winning combination such as a winning combination disposed on a win line, the player wins a prize.

Figure 10:
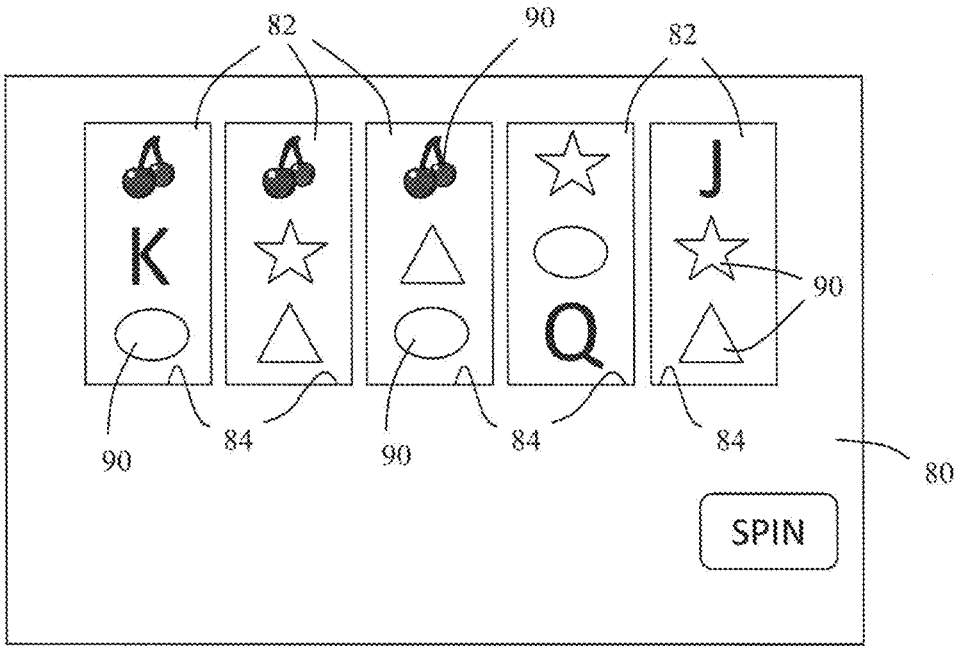
FIGS. 10 and 11 are diagrammatic representations of a display device of a gaming system shown during implementation of a game.

As shown in FIG. 10, during normal game mode, the shutter 86 is disposed in the open configuration and the mechanical reels 82 are visible through the apertures 84 in the video display unit 80. In this example, five mechanical reels are provided. Each reel 82 corresponds to a display position group, and the apertures 84 are configured such that three symbols 90 are visible on each reel. However, it will be understood that any number of reels may be provided and any number of symbols may be visible on each reel.

During implementation 254 of a base game, the reels are spun and subsequently stopped to show a plurality of symbols 90 in the display area defined by the apertures 84. Winning outcomes are determined with reference to symbols 90 appearing in the display area, for example along defined win lines.

The outcome generator 28 determines whether the symbols displayed correspond to a winning outcome and, if a winning outcome exists, a prize associated with the winning outcome is awarded 256 to the player. This determination is made by comparing the displayed symbols with a pay table or similar.

If a predefined game outcome occurs 258 during the base game, such as display of a defined combination of symbols, the gaming system implements a feature game.

Figure 11:
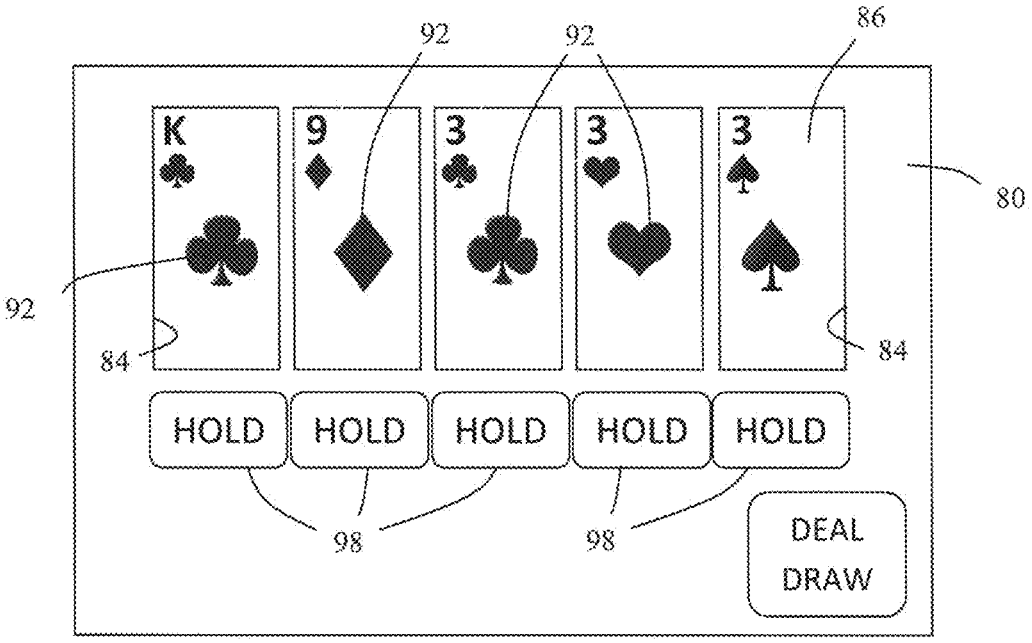

During implementation of the feature game, the shutter 86 is caused to move 260 to the closed configuration and, as shown in FIG. 11, the shutter 86 incorporating the shutter video display device is visible through the apertures 84. Five symbols are selected by the gaming system and the selected symbols, in this example representations of playing cards 92, are displayed on the shutter 86 such that a playing card is visible through each of the apertures 84.

The player is then provided with the option of replacing one or more, but not all, of the playing cards 92, in this example by selecting one or more card to keep by touching corresponding hold buttons 98 on the touch screen 107 disposed over the video display unit 80. Playing cards that are not selected by the player are then replaced with new playing cards, and the outcome generator 28 determines whether the displayed playing cards correspond to a winning outcome according to poker game rules.

Figure 9:
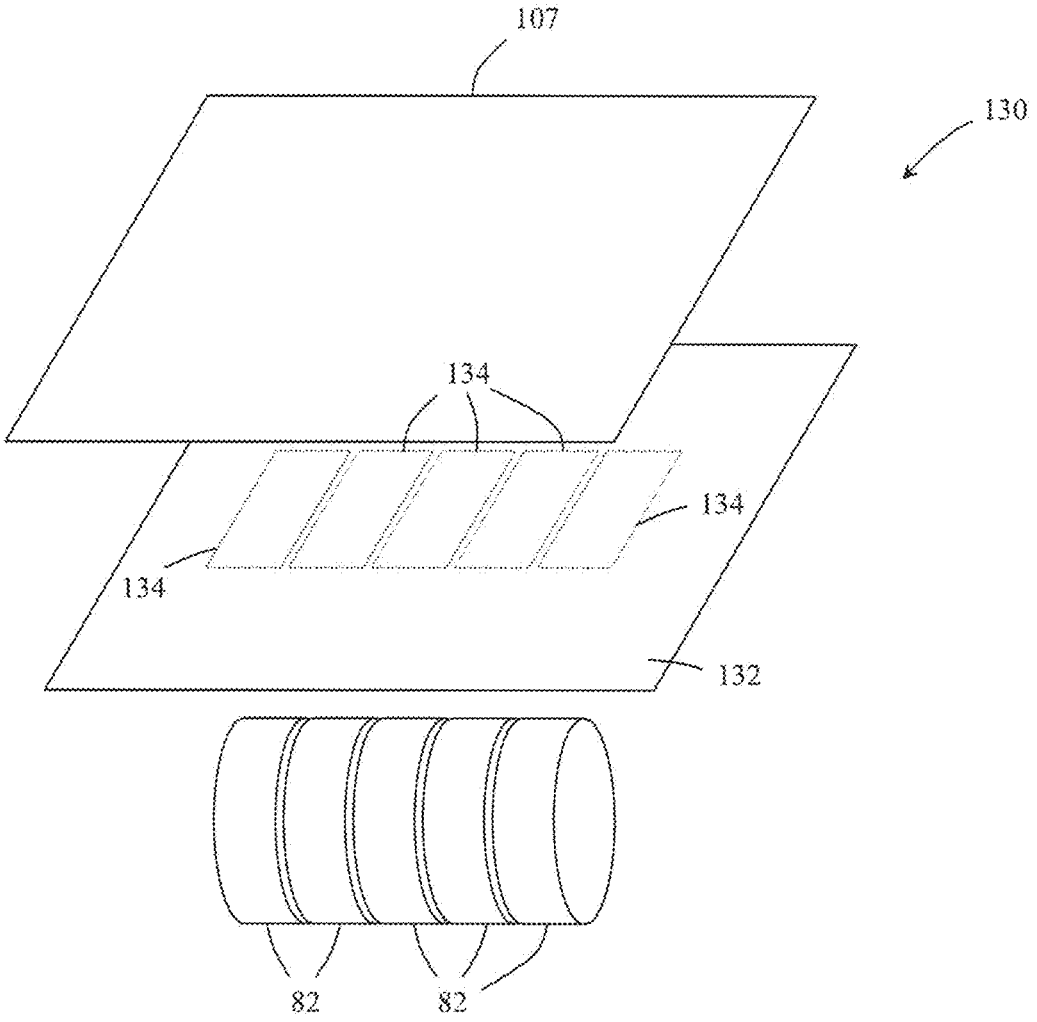
FIG. 9 is a diagrammatic representation of an alternative display device of the gaming machine shown in FIG. 3.

An alternative display device 130 for use with an alternative embodiment of a gaming system is shown in FIG. 9. Like and similar features are indicated with like reference numerals.

With this embodiment, instead of a cover member 80 provided with apertures 84, and a mechanical shutter 86 movable so as to cover or not cover the apertures 84, the cover member may comprise a video display unit 132 arranged so as to implement the function of a shutter device. This is achieved by arranging the video display unit 132 so that the video display unit 132 is operable in a substantially transparent state wherein a display area 134 is substantially transparent, and in a substantially non-transparent state wherein the display area is substantially not transparent. When the video display unit 132 is in the substantially non-transparent state, the selected first symbols are not visible through the video display unit 132. Also when the video display unit 132 is in the substantially non-transparent state, the video display unit 132 is controlled so as to display the selected second symbols.

While the present embodiment is described in relation to a spinning reel type base game and a video poker type feature game, it will be understood that any suitable games are envisaged for the base and feature games, including a video poker type base game and a spinning reel type feature game.

While the present embodiment is described in relation to a mechanical type base game and a video type feature game, it will be understood that other arrangements are envisaged. For example, both of the base and feature games may be video type games.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

Modifications and variations as would be apparent to a skilled addressee are determined to be within the scope of the present invention.

The invention claimed is:

1. A gaming system comprising:

a random number generator;

a display having a plurality of display position areas;

a credit input mechanism configured to accept a credit for establishing a credit balance;

a controller configured, in response to accepting the credit at the credit input mechanism, to conduct a first game having a first theme and a first game outcome, and to conduct a different second game and a second theme having a second game outcome independent of the first game outcome;

a selector configured to randomly select, via the random number generator, a plurality of first symbols from a first set of symbols related to the first theme, the plurality of first symbols forming the first game outcome for display in one of the plurality of display position areas; and a shutter device selectively movable between a closed configuration and an open configuration, the shutter device positioned to conceal the one of the plurality of display position areas from a player when in the closed configuration, wherein the one of the plurality of display position areas is exposed to the player when in the open position; and wherein the selector is further configured to randomly select, via the random number generator, a plurality of second symbols from a second set of symbols related to the second theme, the plurality of second symbols forming the second game outcome; and wherein the shutter device comprises a display device configured to display the second game outcome based on the randomly selected second symbols at a location corresponding to the one of the plurality of display position areas when the shutter device is disposed in the closed configuration to conceal the first outcome formed from the plurality of first symbols.

2. A gaming system as claimed in claim 1, and further comprising a cover member disposed in front of the one of the display position areas, wherein the one of the plurality of display position areas is visible through the cover member when the shutter device is disposed in the open configuration and the one of the plurality of display position areas is not visible through the cover member when the shutter device is disposed in the closed configuration.

3. A gaming system as claimed in claim 2, wherein the cover member comprises at least one aperture and the shutter device is configured to cover the at least one aperture when the shutter device is disposed in the closed configuration.

4. A gaming system as claimed in claim 1, wherein the shutter device is configured to be reciprocably movable between the open configuration and the closed configuration.

5. A gaming system as claimed in claim 1, and further comprising a touch screen usable by a player to control operation of a game associated with at least one of the first and second set of symbols.

6. A gaming system as claimed in claim 1, and further comprising a plurality of reels.

7. A gaming system as claimed in claim 6, wherein each reel of the plurality of reels is a physical reel.

8. A gaming system as claimed in claim 6, wherein each reel of the plurality of reels is a virtual reel.

9. A gaming system as claimed in claim 6, wherein the first set of symbols are associated with the plurality of reels having associated stopping positions; and wherein the selector is configured to select symbols from the first set of symbols by controlling the stopping positions of the plurality of reels.

10. A gaming system as claimed in claim 1, wherein the second set of symbols comprises representations of playing cards, and the gaming system is configured to determine whether the selected second set of symbols corresponds to a winning outcome according to rules for poker.

11. A gaming system as claimed in claim 6, wherein the shutter device comprises a shutter member being configured to conceal the plurality of reels when the shutter device is disposed in the closed configuration.

12. A gaming system as claimed in claim 6, wherein the shutter device comprises a shutter member for each reel of the plurality of reels, each shutter member being configured to conceal the reel when the shutter device is disposed in the closed configuration.

13. A gaming system as claimed in claim 1, wherein the gaming system is operable in one of a base game mode and a special game mode, wherein:

in the base game mode, the shutter device is disposed in the open configuration and second symbols are not selected; and in the special game mode, the shutter device is disposed in the closed configuration and second symbols are selected and displayed on the shutter device.

14. A gaming system as claimed in claim 13, wherein the gaming system is configured to commence the special game mode when a trigger condition occurs.

15. A gaming system as claimed in claim 14, wherein the gaming system is configured to commence the special game mode in response to player input, based on at least one of the amount of the accepted credit, type of bet placed, and when a special game is purchased by a player.

16. A gaming system as claimed in claim 15, wherein the trigger condition comprises at least one of a display of a particular symbol, and a display of a defined symbol combination.

17. A method of gaming in a gaming system operable to conduct a first game having a first theme and a first game outcome, and to conduct a different second game having a second theme and a second game outcome independent of the first game outcome, the gaming system including a random number generator, a credit input mechanism configured to accept a credit for establishing a credit balance, a controller, a display having a plurality of display position areas, and a shutter device being selectively movable between a closed configuration and an open configuration, the shutter device positioned to conceal one of the plurality of display position areas from a player when in the closed configuration, wherein at least one of the plurality of display position areas is exposed to the player when in the open position, the method comprising:

accepting a credit at the credit input mechanism;

in response to accepting the credit, randomly selecting, via the controller and the random number generator, a plurality of first symbols from a first set of symbols related to the first theme of the first game;

displaying the first game outcome formed from the selected first symbols in one of the plurality of display position areas;

randomly selecting, via the random number generator, a plurality of second symbols from a second set of symbols related to the second theme of the different second game to form the second game outcome; and displaying the second game outcome on the shutter device at a location corresponding to the one of the plurality of display position areas when the shutter device is moved to the closed configuration to conceal the first outcome formed from the plurality of first symbols.

18. A method as claimed in claim 17, wherein the gaming system further comprises a cover member disposed in front of one of the plurality of display position areas, wherein the one of the plurality of display position areas is visible through the cover member when the shutter device is disposed in the open configuration and the one of the plurality of display position areas is not visible through the cover member when the shutter device is disposed in the closed configuration.

19. A method as claimed in claim 18, wherein the cover member further comprises at least one aperture, and wherein the method further comprises covering the at least one aperture with the shutter device when the shutter device is disposed in the closed configuration.

20. A method as claimed in claim 17, and further comprising facilitating reciprocal movement of the shutter device between the open configuration and the closed configuration.

21. A method as claimed in claim 17, wherein the gaming system further comprises a touch screen usable by a player to control operation of a game associated with at least one of the first and second set of symbols.

22. A method as claimed in claim 17, wherein the gaming system further comprises a plurality of reels.

23. A method as claimed in claim 22, wherein each reel of the plurality of reels is a physical reel.

24. A method as claimed in claim 22, wherein each reel of the plurality of reels is a virtual reel.

25. A method as claimed in claim 22, wherein each reel of the plurality of reels has a plurality of stopping positions, and wherein the method further comprises:

associating the first set of symbols with the reels; and selecting symbols from the first set of symbols by controlling the stopping positions of the reels.

26. A method as claimed in claim 17, wherein the second set of symbols comprises representations of playing cards, and the method further comprises determining whether the selected second set of symbols corresponds to a winning outcome according to rules for poker.

27. A method as claimed in claim 22, wherein the gaming system further comprises a shutter member, and wherein the method further comprises concealing with the shutter member the reels when the shutter device is disposed in the closed configuration.

28. A method as claimed in claim 22, wherein the gaming system further comprises a shutter member for each reel of the plurality of reels, and wherein the method further comprises concealing, with each shutter member, the reel when the shutter device is disposed in the closed configuration.

29. A method as claimed in claim 17, wherein the gaming system is operable in one of a base game mode and a special game mode, wherein the method further comprises:

in the base game mode, disposing the shutter device in the open configuration and second symbols are not selected; and in the special game mode, disposing the shutter device in the closed configuration and second symbols are selected and displayed on the shutter device.

30. A method as claimed in claim 29, and further comprising commencing the special game mode when a trigger condition occurs.

31. A method as claimed in claim 30, and further comprising commencing the special game mode in response to player input, based on at least one of the amount of the accepted credit, type of bet placed, and when a special game is purchased by a player.

32. A method as claimed in claim 31, wherein the trigger condition comprises at least one of: a display of a particular symbol and a display of a defined symbol combination.

* * * * *